US008261385B2

(12) United States Patent
Mazzei et al.

(10) Patent No.: US 8,261,385 B2
(45) Date of Patent: Sep. 11, 2012

(54) TABLE ENGAGEABLE SUPPORT FOR HEAD CUSHION SUPPORTING ANESTHETIZED PATIENT

(76) Inventors: William J Mazzei, San Diego, CA (US); Gregory P. Jordan, Carlsbad, CA (US); An B. Vu, Carlsbad, CA (US)

( * ) Notice: Subject to any disclaimer, the term of this patent is extended or adjusted under 35 U.S.C. 154(b) by 0 days.

(21) Appl. No.: 12/284,604

(22) Filed: Sep. 22, 2008

(65) Prior Publication Data

US 2009/0025146 A1 Jan. 29, 2009

Related U.S. Application Data

(63) Continuation-in-part of application No. 10/954,581, filed on Sep. 29, 2004, now Pat. No. 7,426,763.

(60) Provisional application No. 60/507,624, filed on Sep. 30, 2003.

(51) Int. Cl.
*A47C 20/02* (2006.01)

(52) U.S. Cl. ..... 5/638; 5/622; 5/643

(58) Field of Classification Search ..... 5/638, 643, 5/621–622
See application file for complete search history.

(56) References Cited

U.S. PATENT DOCUMENTS 4,752,064 A * 6/1988 Voss ..... 5/638
6,490,737 B1 * 12/2002 Mazzei et al. ..... 2/410
6,928,679 B1 * 8/2005 Gross ..... 5/638

* cited by examiner

*Primary Examiner* — Fredrick Conley
(74) *Attorney, Agent, or Firm* — Donn K. Harms

(57) ABSTRACT

A support for the head of a patient lying in a generally prone position. The support features a tray adapted for support on an underlying operating table surface. A plurality of pins projecting from an engagement with the tray are positioned to engage and suspend either a cushion directly or a cushion engaged in a casing. The pins may be adjusted to raise or lower the engaged cushion or casing. A mirror is also provided to provide a reflective view a patient's eyes through slots in the cushion and casing engaged over a patient's face. A video camera may also concurrently be employed to capture electronic images of the patient's eyes and mouth through an aperture in the mirror.

12 Claims, 9 Drawing Sheets

TABLE ENGAGEABLE SUPPORT FOR HEAD CUSHION SUPPORTING ANESTHETIZED PATIENT

This application is a continuation in part of U.S. patent application Ser. No. 10/954,581 filed on Sep. 29, 2004 now U.S. Pat. No. 7,426,763 which claims priority from U.S. provisional application Ser. No. 60/507,624, filed Sep. 30, 2003, both of which are incorporated by reference herein in their entirety.

BACKGROUND OF THE INVENTION

1. Field of the Invention

The present invention relates to a table engageable support for the head support or the cushion used for the head of an anesthetized patient. More particularly it relates to a tray which will either cooperatively mount upon struts projecting from the table used for supporting anesthetized patients, or engage the table by placing the tray portion upon the top of the operating table. The device has a top surface adapted to cooperatively engage with the pillow or pillow holder used to support the patient's head. It also can be configured with projections engaged with the side edges of the tray which then may engage with table struts commonly used on some tables for patients placed in the face down or in the prone position.

2. Prior Art

Surgeries upon patients in the prone position present a number of patient care challenges to the anesthesiologist and surgical staff. Once a patient undergoing a surgery requiring general anesthesia is anesthetized, that patient is essentially in a coma like state. In such a state, noxious stimuli to the patient's body and skin, such as pressure or pain, which would normally cause an awake patient to move to relieve the stimulus, no longer causes such a reaction. Consequently, patients under general anesthesia are especially threatened by a number of factors, other than the surgery itself, which arise during such surgical procedures.

One hazard which requires constant vigilance by the surgical staff to protect against injury is the threat of eye damage. Inadvertent pressure upon the ocular structures of a patient for just a matter of minutes can cause extreme damage or blindness to the eye. As noted above, because the anesthetized patient is in a coma like state, the discomfort of facial compression upon the eye, which would normally cause an awake patient to move and relieve that pressure, fails to alert the anesthetized patient. Care must be taken by an ever alert surgical staff to inspect for possible pressure points about the ocular structures of the patient and to move the patient's face to prevent eye damage.

Other compression injuries can occur to the anesthetized patent's forehead and chin areas or to the neck if the head is misaligned with the back when the patient is placed on the table for an extended period. Here again, the constant pressure upon those areas of the face or the neck bones and nerves, caused by the weight of the patient's own head, if not relieved by movement of the face to allow blood flow thereto, can cause localized ischemia to the chin and forehead area. Since the anesthetized patient does not react to the body's cues of discomfort preceding injury, the risk of harm in a matter of minutes to these areas is great.

Currently, there are a number of conventional methods to support the head and protect the eyes and face of a patient from compression injuries during surgery which require the patient to be placed in a prone, face down position for the long periods of time involved in surgery.

One of the best systems available uses a protective cushion which cooperatively engages with a helmet casing which is placed upon a mounting surface such as an operating table top which is best shown in U.S. Pat. Nos. 6,112,333 (Mazzei, et al.) and 6,490,737 (Mazzei, et al.) which should be incorporated herein for reference. The system disclosed in these patents uses a cushion shaped to engage the patient's face on one side and dimensioned for cooperative engagement with a casing on the opposite side of the cushion. The casing is designed for mounting upon a surface such as the operating table thereby providing complete support to the head of the patient and virtually eliminating the dangers to the face and nerves of the patient during long operations.

SUMMARY OF THE INVENTION

The device herein disclosed is designed to cooperatively engage between the head supporting cushions and the operating table or underlying mounting surface, or with a casing engaged with the exterior of a cushion as described in the aforementioned patents.

As shown in FIGS. 1-7, the device has a top surface with projections therefrom and is configured for cooperative engagement with the cushion by itself if the head support cushion is used without a cooperatively engaged casing to support it. In another preferred mode of the device, however, the top surface has projections therefrom that are positioned to register in engagement with cooperatively engaging legs from a casing used to support casing-engaged cushion.

When used with just the head supporting cushion, the device disclosed provides a flat top surface that will allow for the support of the cushion thereon during surgery. From the bottom of the tray projects a means for height adjustment of the top surface or projections from the top surface in the form of translating legs which are user adjustable. The mirrored top surface provides a view of the patient's face when using a cushion with the appropriate slots to yield such a reflection. Further, a pair of rails may be engaged to the tray along side edges and dimensioned to engage struts which commonly are used on operating tables where there is no table top in the area of the patient's head. These rails when so engaged thereby provide a surface for the cushion for support of the cushion between the struts. Such a strut and table configuration is conventionally used in operating tables such as those manufactured by Orthopedic Systems Inc. of Union City, Calif. which markets a table known as the Jackson Spinal Surgery Top table.

When configured in a highly preferred mode, the device herein features a tray having a top surface which has a plurality of pins projecting from it. The pins are adapted to cooperatively engage with the legs projecting from the bottom of the casing used to hold the cushion in place in supporting the patient's head or the pins may engage the exterior surface of the cushion if no casing is employed. The pins are positioned on the top surface such that they provide a means to engage the cushion or the casing if employed, in a registered position on the tray. Also in this highly preferred mode of the device, the top surface is mirrored and thereby provides a reflection of the patient's face which may be viewed by the medical staff during the operation.

The pins projecting from the top surface provide a number of other functions that may be used singularly or in combination to provide the most utility from the device. First, the pins have a spiral slot about their exterior surface which form the pins into a spring-like structure with a leg engaging tip. This spring-like structure provides a means for vertical shock absorption to the head of the patient when weight from the head bears down on the cushion or on the cushion engaged with the casing. The spiraled pins engaging the cushion or casing also provide a lateral shock dampening ability in that if the head of the patient engaged in the cushion is moved sideways from body movement, the pins will tend to flex laterally allowing the casing and the cushion to move sideways substantially parallel to the top surface for a short distance. This sideways flexibility provides a second or lateral shock absorption means to the device.

Also provided by the pins projecting from the top surface is a means to independently adjust the height of each pin above the top surface thereby providing a means to adjust the height of the cushion or casing and engaged cushion. This provides the means to the medical staff to angle the head of the prone patient about a horizontal plane to an angle that is best suited for the operation being performed and to provide the most comfort to the patient. This means to adjust the height of the individual pins above the top surface in the current mode is provided by the pins being threaded about an internal axial passage. The axial threads are engaged upon a threaded member projecting from the top surface and the height of the pin above the top surface is easily adjusted by simply twisting the pin and laterally translating it in its engagement with the threaded member.

Or, as shown in the drawings in a preferred mode of the device, the threaded members may project through the tray from the bottom surface and have an adjustment foot at the distal ends of the members. This adjustment foot provides a mount when the device is used on a table top as well as providing a means to twist the threaded members and thereby cause the translation of the pins above and back to the top surface of the tray as the case may be. Of course each adjustment foot may be adjusted independently to thereby adjust each pin in its distance above the top surface of the tray to adjust the height of the casing and its angle above the top surface.

Since each pin is independently adjustable, a means for head rotation or position adjustment about a vertical axis is also provided. By adjusting two of the pins on one side to raise or lower the patient's head, the cushion may be rotated to one side or the other if need be.

As noted, the device will operate with the adjustment feet providing a mount for the threaded members on a table top. If, however, the device is used with an operating table having struts projecting from a table supporting the torso of the patient, then the side rails may be engaged and are dimensioned to cooperatively engage over the struts projecting from one end of the table. The employment of the side rails thus provides a means of cooperative engagement of the tray with the operating table having such struts and lacking any support surface in-between the struts.

In use in a mount over the struts, the rails are "U" shaped and would sit upon the struts in the depicted drawings. When used in this fashion, the device becomes especially useful since the height and angle of the patient's head can be adjusted by simply reaching under the tray and twisting the individual adjustment feet attached to the distal ends of the threaded members. Twisting the threaded members causes the pins to rise and fall in their distance from the top surface. The threaded members would be engaged with threads in the tray in all of the embodiments where they project from the bottom surface thereby translating the top ends of the threaded members and the attached pins toward and away from the top surface of the tray during adjustment. If, however, the projection from the bottom surface is not needed, then the threaded members might just be attached into the top surface of the tray and adjustment of the height of the individual pins could be accomplished by spinning the pin itself in its engagement on the projecting threaded member.

Also provided on the device is a series of apertures in the side rails on one or both sides which would provide an excellent passage for the tubes and other conduits used during an operation employing the side rails for communication of fluids and air to the patient.

An object of this invention is to provide a device to adjust the height of the head a patient on an operating table by adjusting the height of the device when supporting the head.

Another object of this invention is to provide a device to adjust the angle of incline of the head of a patient on an operating table.

A further object of this invention is to provide a device to adjust the rotation of a patient's head around the axis of their neck when on the operating table.

Another object of this invention is the provision of an adjustable mount that will interface between an operating table and a casing and cushion style of head support for a patient.

A further object of this invention is the provision of an adjustable mount that will interface between an operating table having projecting struts in the area of the head of the patient and providing thereby a surface for the casing and cushion style of head support for a patient.

An additional object of this invention is the provision of a table and casing interface device allowing for very precise angling of the casing from underneath the table supporting pins which engage the casing holding the cushion.

Further objects of the invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF THE PREFERRED EMBODIMENTS OF THE INVENTION

Figure 1:
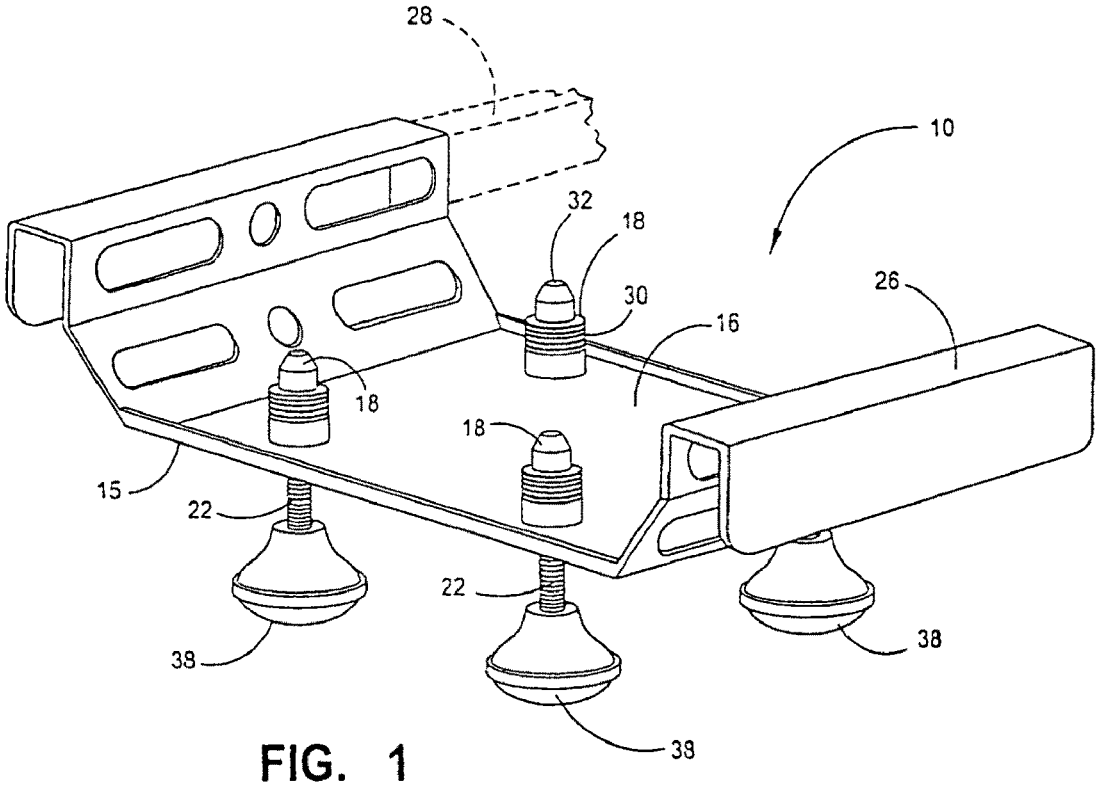
FIG. 1 is a perspective frontal view of the table engageable support, with rails engaged, for engagement with the head cushion and/or the casing.

Referring now to the drawings, FIGS. 1-7 depict the various embodiments and engagements of the disclosed table engageable support device 10 for engagement with the head cushion 12 or cushion 12 engaged with a casing 14.

The device 10 herein disclosed is designed to cooperatively engage between the head supporting cushions 12, or the engaged cushion 12 and casing 14 and provide adjustable support to the head of a patient on an operating table. As shown in different embodiments in the figures, the device 10 has a tray 15 with a top surface 16 which is adapted to cooperatively engage with the cushion 12 by itself if the head support cushion 12 is used without a cooperatively engaged casing 14.

In a preferred mode of the device 10 the top surface 16 of the tray 15 has a plurality of projections extending therefrom in a spaced arrangement in the form of pins 18 adapted for engagement with detents or other engagement means in the exterior surface of a supported cushion 12 or with cooperatively engaging legs 20 or other means for cooperative engagement located on the bottom or exterior of a cushion 12 or supporting casing 14. The current preferred number of pins 18 is four to allow for the aforementioned axial and incline adjustments. However, three pins 18 might work and more than four may be in some cases desired; consequently, other total numbers of pins 18 in the plurality are anticipated. Of course various means of engagement between the pins 18 and the exterior surface of the cushion 12 or the casing 14 can be substituted and such is anticipated so long as once engaged they hold the cushion in the desired position. If, however, the device 10 is used with just the head supporting cushion 12 and without the pins 18, the device 10 still provides a flat top surface 16 to support the cushion 12 thereon during surgery.

The pins 18 provide a means for height adjustment of the cushion 12 whether engaged directly or with the casing sandwiched therebetween. The pins 18 as noted engage the threaded member 22 about an axial internal engaging passage (not shown). Currently such a threaded engagement works well to provide an easily adjusted means for lateral translation of the pins 18 toward and away from the surface 16 during use to adjust the height of an engaged patent's head above the surface 16 and the angle of incline of the neck of that patient. If the threaded members 22 communicate through the tray 15, adjustment can also be achieved from the bottom of the tray 15 by twisting of the threaded members 22 from this side of the tray 15.

The mirrored top surface 16 provides an excellent reflective view of the patient's face when using a cushion 14 with the appropriate slots 24 to yield such a reflection. With the cushion shown in FIG. 2, with the slot 24 for eye viewing continuing up the side of the cushion 12, preferably just past the edge of the eye of the patient closest to their ear, viewing of the eye of the patient is easily accomplished from a viewing position above the head of the patient and at a slight angle. Without this elongated slot 24 continuing up the side of the cushion 12 and a similar slot 24 in the casing 14, viewing the patient's eyes during surgery would require that a person viewing stoop below or level with the head of the patient.

A pair of rails 26, are engageable with the tray 15 along side edges of the tray 15. The rails 26 are dimensioned and positioned to engage struts 28 extending from one end of the table which commonly are used on operating tables where there is no table top in the area of the patient's head. Such struts 28 replace the underlying surface of the table and provide the support for the tray 15 through rails 26. By employing the rails 26 engaged with the tray 15, a surface to replace the table top 40 is provided for the cushion 12 to be supported between the struts 28 when the device 10 is employed for use with such tables. The tray 15 so supported can then engage either the cushion exterior or the casing 14 depending on the configuration employed.

Figure 2:
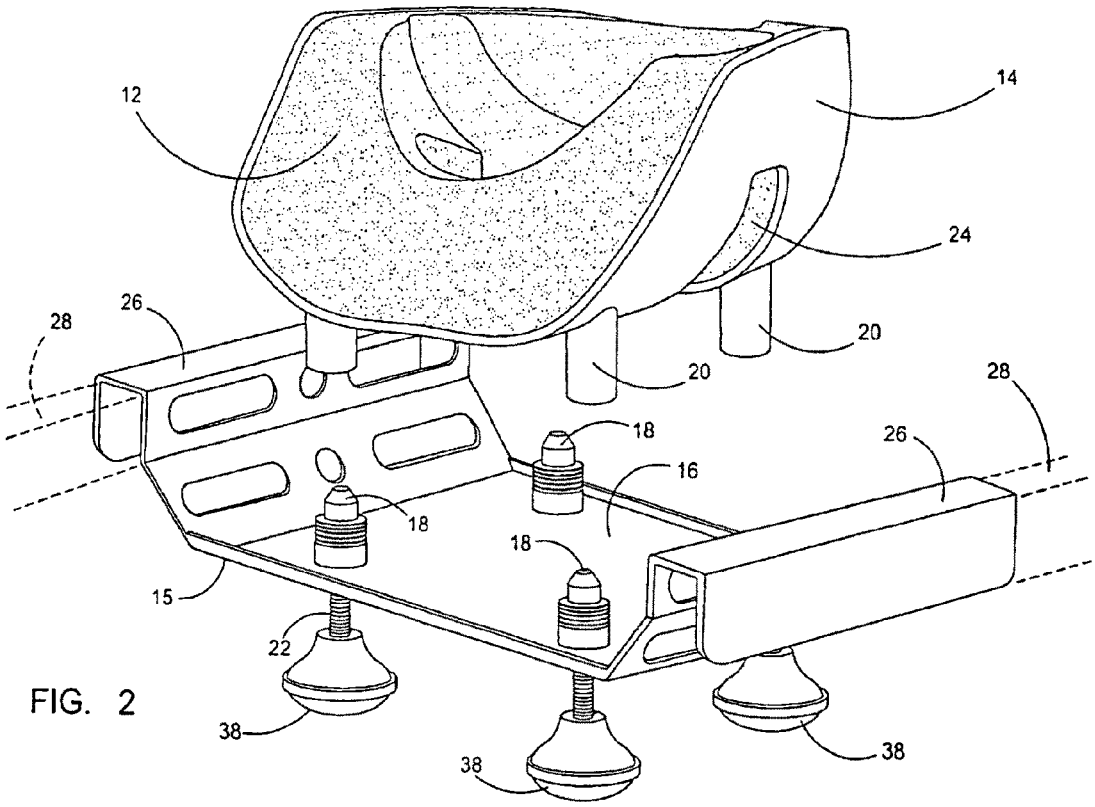
FIG. 2 is a perspective view of the device showing the tray with rails engaged, supported on legs having feet placed on a conventional table top style operating table.
Figure 3:
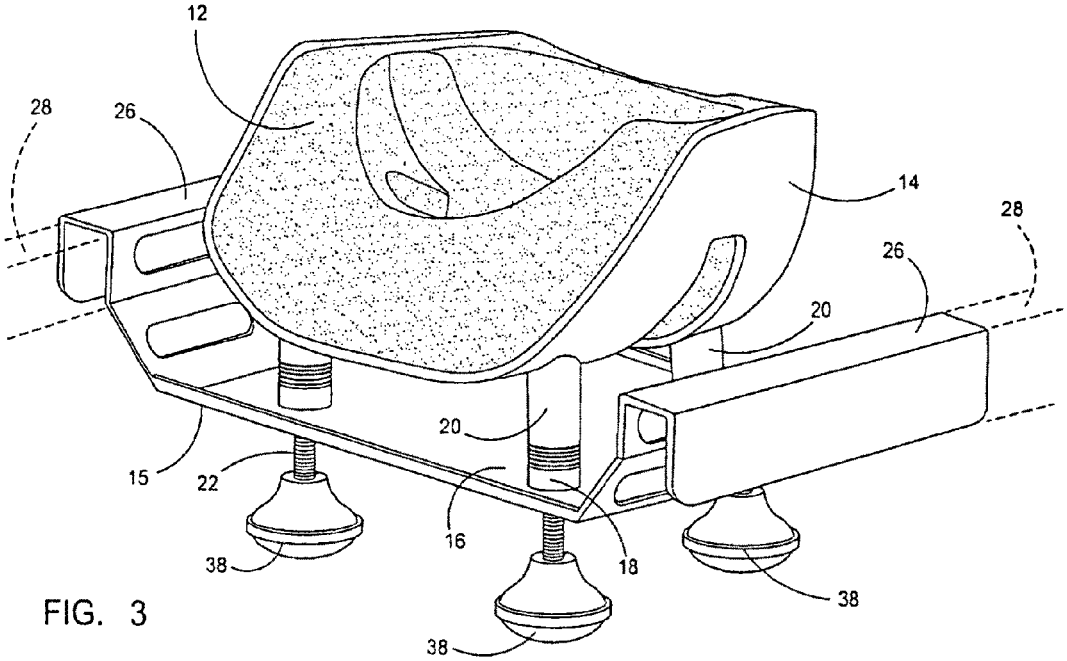
FIG. 3 is a perspective frontal view of the table engageable support for the head cushion and casing for an anesthetized patient showing a mounting on a strut style operating table where the struts project from the table supporting the torso.
Figure 4:
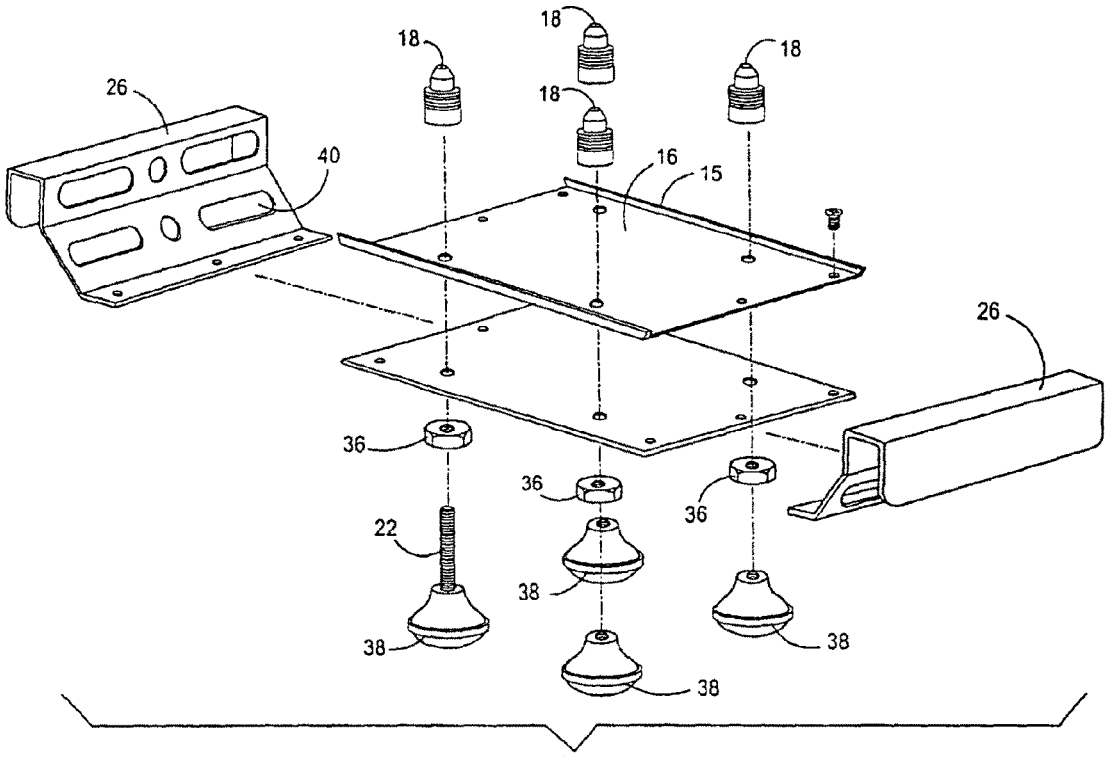
FIG. 4 is an exploded view of FIG. 1 showing the support tray and engageable rails.
Figure 5:
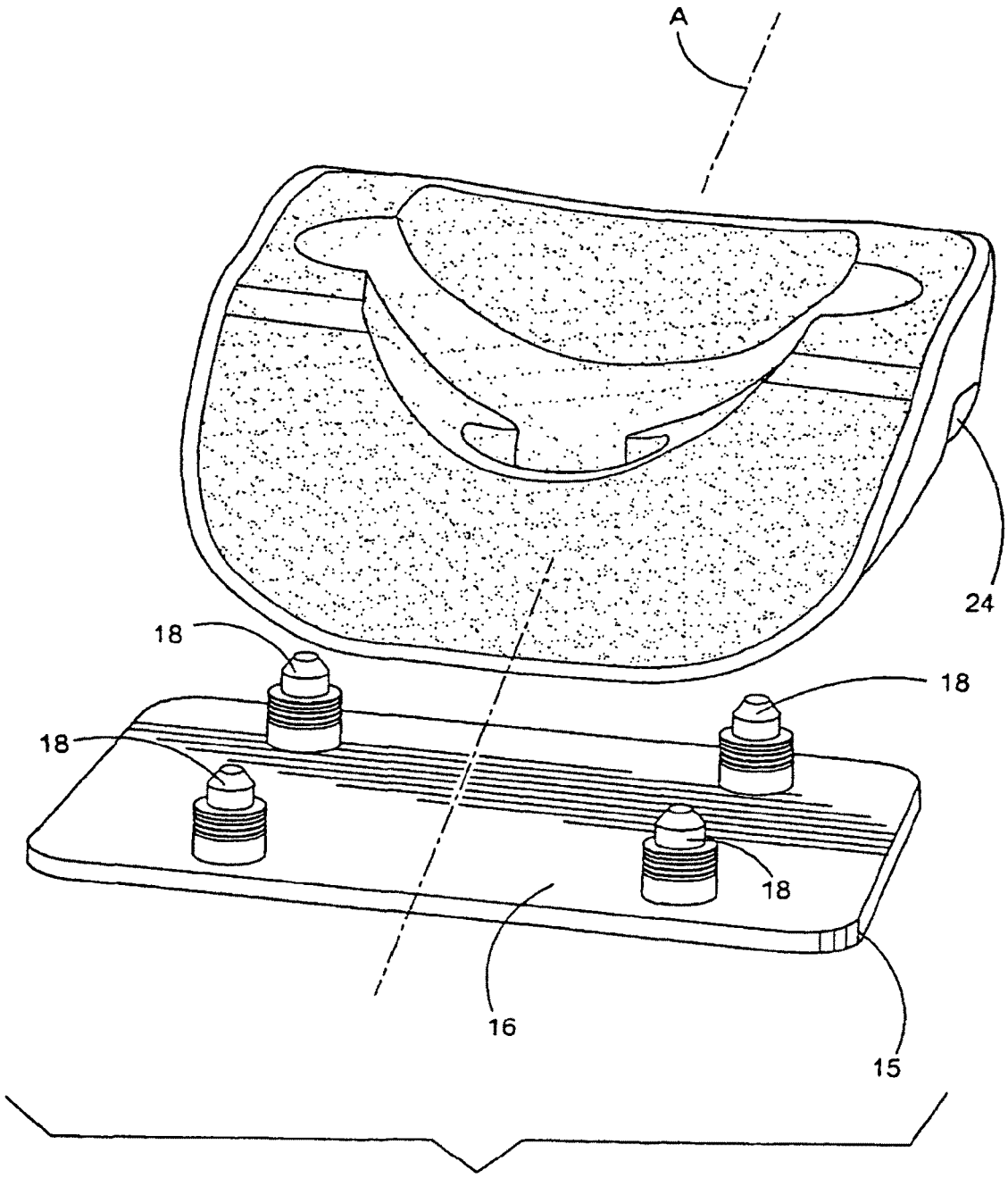
FIG. 5 depicts the support tray without the engageable rails and a cushion adapted on its exterior surface to engage with projecting pins.

As noted, when configured in a preferred mode, the device 10 provides the tray 15 having a top surface 16 which has a plurality of pins 18 projecting from it above the top surface 16. The pins 18 are adapted to cooperatively engage with the cushion exterior or as shown in FIG. 2 with the casing exterior using means for engagement of the pins 18 such as legs 20 projecting from the bottom of the casing 14 which as shown would have a hollow portion at their distal ends to engage over the pins 18. The casing 14 in this configuration cooperatively engages the cushion 12 in a registered engagement to hold the cushion 12 in place during its support of a patient's head with the slots 24 in registered engagement. The pins 18 so positioned on the top surface 16 also provide a means to engage the casing 14 or cushion 12 in a registered engagement of its position above the top surface 16 of the tray 15. Also in a particularly preferred mode of the device 10, the top surface 16 is mirrored and thereby provides a reflection of the patient's face which may be viewed by the medical staff during the operation from above the patient's head.

As noted above, the pins 18 provide a number of other functions that may be used singularly or in combination to provide the most utility from the device 10. First, the pins may be configured with a spiral slot 30 about their exterior surface which form the pins 18 forming them into a spring like structure with a leg engaging tip 32. This spring-like structure provides a means for shock absorption to the head of the patient when weight from the head bears down on the engaged casing or if the head is bumped during surgery. The spiraled pins 18 engaging the casing also provide a lateral shock dampening ability in that if the head of the patient engaged in the cushion is moved sideways from body movement, the pins will tend to flex laterally allowing the casing and the cushion to move sideways substantially parallel to the top surface 16 for a short distance. This provides a second or lateral shock absorption means to the device. Those skilled in the art will no doubt realize that other springs and such could be used with the pins 18 to yield this shock absorbing means and such are anticipated.

Also provided by the pins 18 projecting from the top surface 16 is a means to adjust the height of the cushion 12 above the top surface 16 either equally or unequally. Since the patient's head is engaged at the neck, any means for height adjustment concurrently provides a means to adjust the angle of incline of the patient's neck while prone on the table. As depicted, each pin 18 may be independently adjusted for the height of the tip 32 above the top surface 16, thereby providing a means to adjust the height of the communicating cushion 12 or the casing 14 and engaged cushion 12. This means to adjust the height of the pins 18 above the top surface 16 in the current preferred mode is provided by the pins 18 being threaded about an axial passage. The axial threads in the pins 18 are engaged then upon the threaded member 22 and the height of the pin above the top surfaces 16 is adjusted by simply twisting the pin 18 and laterally translating it in its engagement with the threaded member.

Or, as shown in the drawings in a current preferred mode of the device 10, the threaded members 22 may project through a nut 36 or threads formed in the tray and from the bottom surface. An adjustment foot 38 may be attached at the distal ends of the members 22 for a better grip. This adjustment foot 38 provides a mount when the device 10 is used on a table top 40 as well as providing a means to twist the threaded members 22 and thereby cause the translation of the pins 18 toward and away from the top surface 16 of the tray as the case may be. Of course each adjustment foot 22 may be adjusted independently to thereby adjust each pin 18 in its distance above the top surface 16 of the tray to adjust the height of the casing 14 and its angle over the top surface 16. Also as noted, independent adjustment of the height of the pins 16 also provides a means to rotate the cushion 12 and the engaged patient's head, around the axis A of the patient's neck. Also provided by adjusting opposing pairs of pins for height is the axis along the angle of incline of the patient's neck which would be an adjustment of the incline of axis A. Adjustments around the axis A would occur by adjusting two pins 18 on one side, higher or lower than the opposite two pins 18. Adjustment of the incline of Axis A and of the head of the patient can occur by adjustment of the pins 18 furthest from the patient's neck, higher or lower than the two pins 18 closest to the patient's neck thereby adjusting the incline of the neck of the prone patient.

Figure 7:
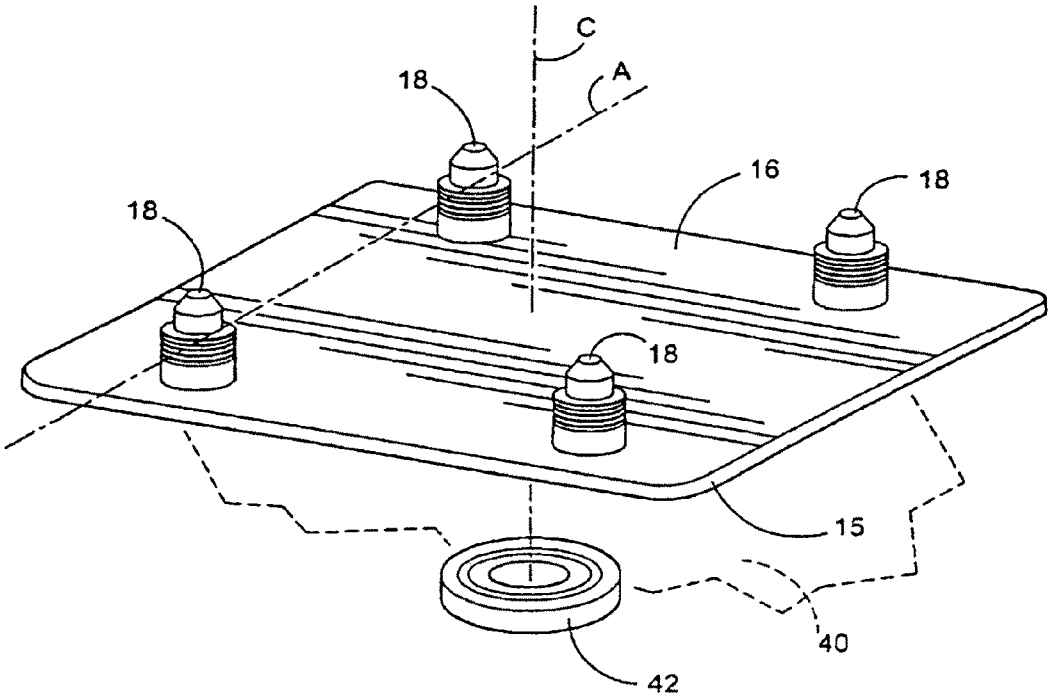
FIG. 7 depicts the cushion engageable tray with the optional rotational lower mount and shows the two axises of adjustment provided by pin height adjustments.

A third adjustment best shown in FIG. 7 can be provided by the inclusion of an optional rotational means of support of the tray 15 to a lower surface supporting it such as the table top 40. As depicted, the rotational means for support of the tray 15 on the underlying surface would feature a bearing 42 interposed between the tray 15 and an underlying surface. Inclusion of the rotational means would provide for positional adjustment around a vertical axis C of the cushion 12 engaged with the tray 15, either directly or with the casing 14.

As noted, the device 10 will operate with the adjustment feet 38 providing a mount for the threaded members on a table top 40 if that type of table is being used. In cases where the device is used in combination with an operating table having struts 28 projecting from the table which supports the patient's torso, then the side rails 26 are adapted for cooperative engagement with the struts and provide a means of cooperative engagement of the device with the operating table. In use in the mode mounted over struts 28 or similar tables having rails with a gap therebetween where the patient's head is positioned, the rails would be adapted to engage the struts or rails accordingly.

When used with tables having struts 26 or rails and a gap therebetween, the device 10 becomes especially useful since the height and angle of the patient's head can be adjusted by simply reaching under the top surface 16 of the tray and twisting the individual adjustment feet 38 attached to the distal ends of the threaded members 22. Twisting the threaded members causes the pins 18 to translate toward or away from the top surface 16. As shown, the threaded members 22 would be engaged with threads in the tray itself or a nut 36 having cooperating threads which attaches to the tray. If, however, the projection from the bottom surface is not needed, then the threaded members might just be attached into the top surface 16 of the tray and adjustment of the height of the individual pins could be accomplished by spinning the pin 18 itself in its engagement on the projecting threaded member.

Also provided on the device 10 are a series of apertures 40 in the side rails 26 on one or both sides which would provide an excellent passage for the tubes and other conduits used during operation for fluids and air to the patient.

Figure 6:
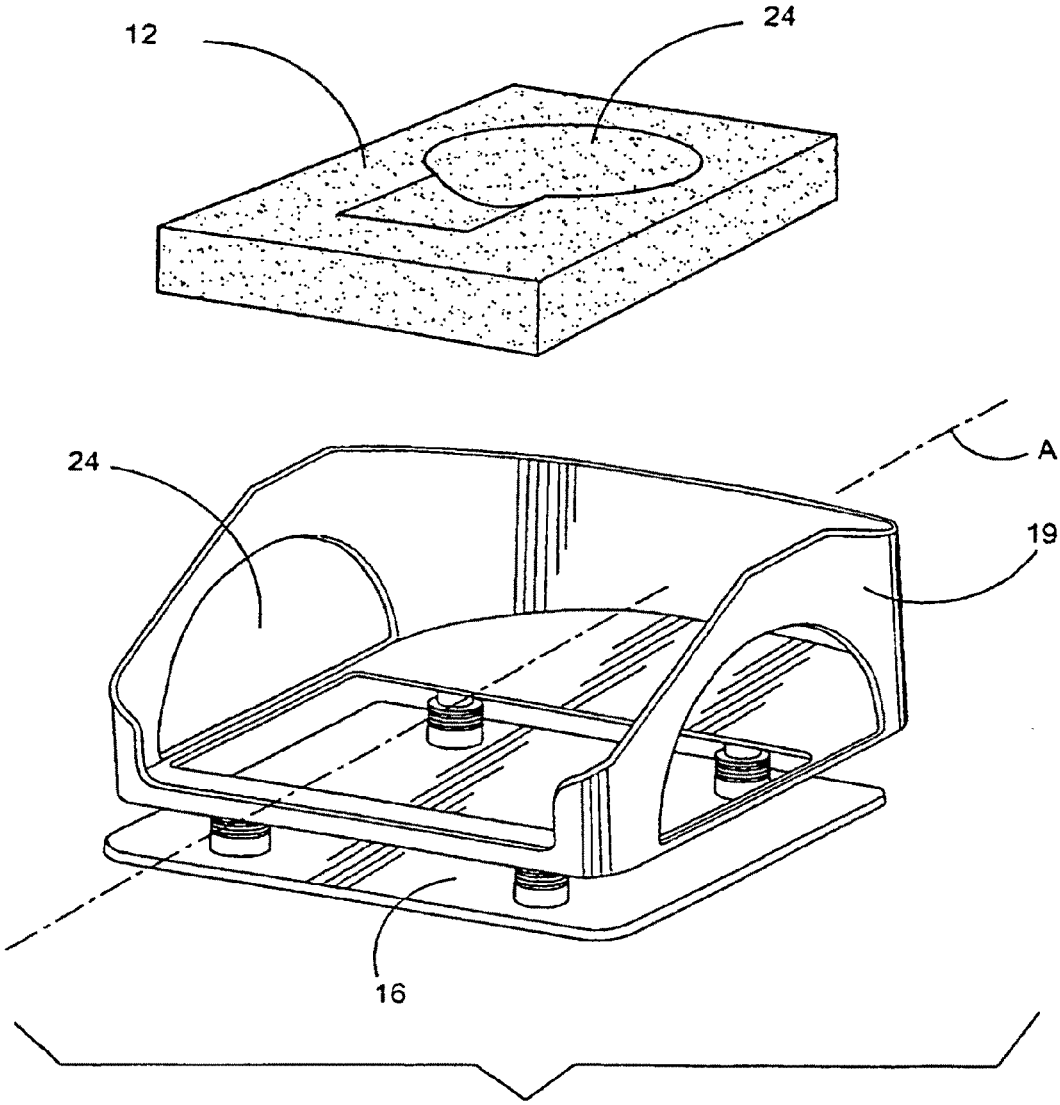
FIG. 6 depicts another embodiment of the disclosed device featuring a casing designed to engage any style cushion and adjustably support it on the adjustable pins above the operating table.

An alternative casing 19 is shown in FIG. 6 which provides support for any cushion 12 that might be used whether the exterior surface is curved or flat. Slots 24 in one or both sides provide an easy viewing path for the eyes of the patient in the mirrored surface 16 of the tray 15 from above the patient's head by simply looking downward through the slot 24 at a slight angle so long as some type of slot is formed in the cushion 12 which provides a view of the patient's eyes. This embodiment of the casing 19 will provide a mounting for virtually any cushion 12 and concurrently provide the aforementioned means to adjust the incline of the patient's neck and means to rotate the patient's head around the axis A, by individual adjustment of the height of the pins 18 from the top surface 16 or adjust the incline of the patient's head along axis A or if the rotational mount is employed, the cushion-engaged head can also be rotated around the vertical axis C shown in FIG. 7.

Figure 8:
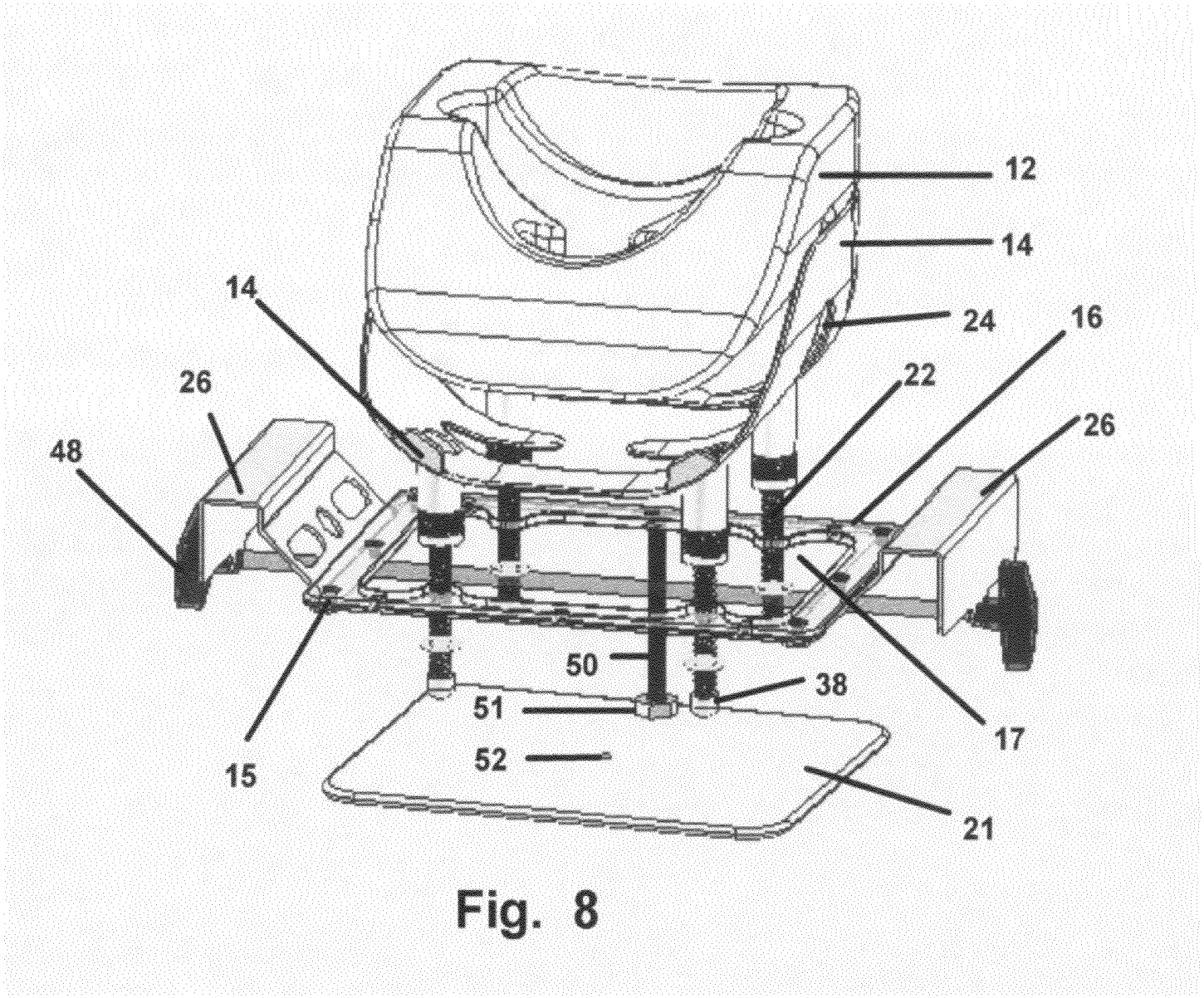
FIG. 8 shows an embodiment of the disclosed device having an aperture formed in the underlying tray to provide a view for a video camera and for a removable mirror.
Figure 9:
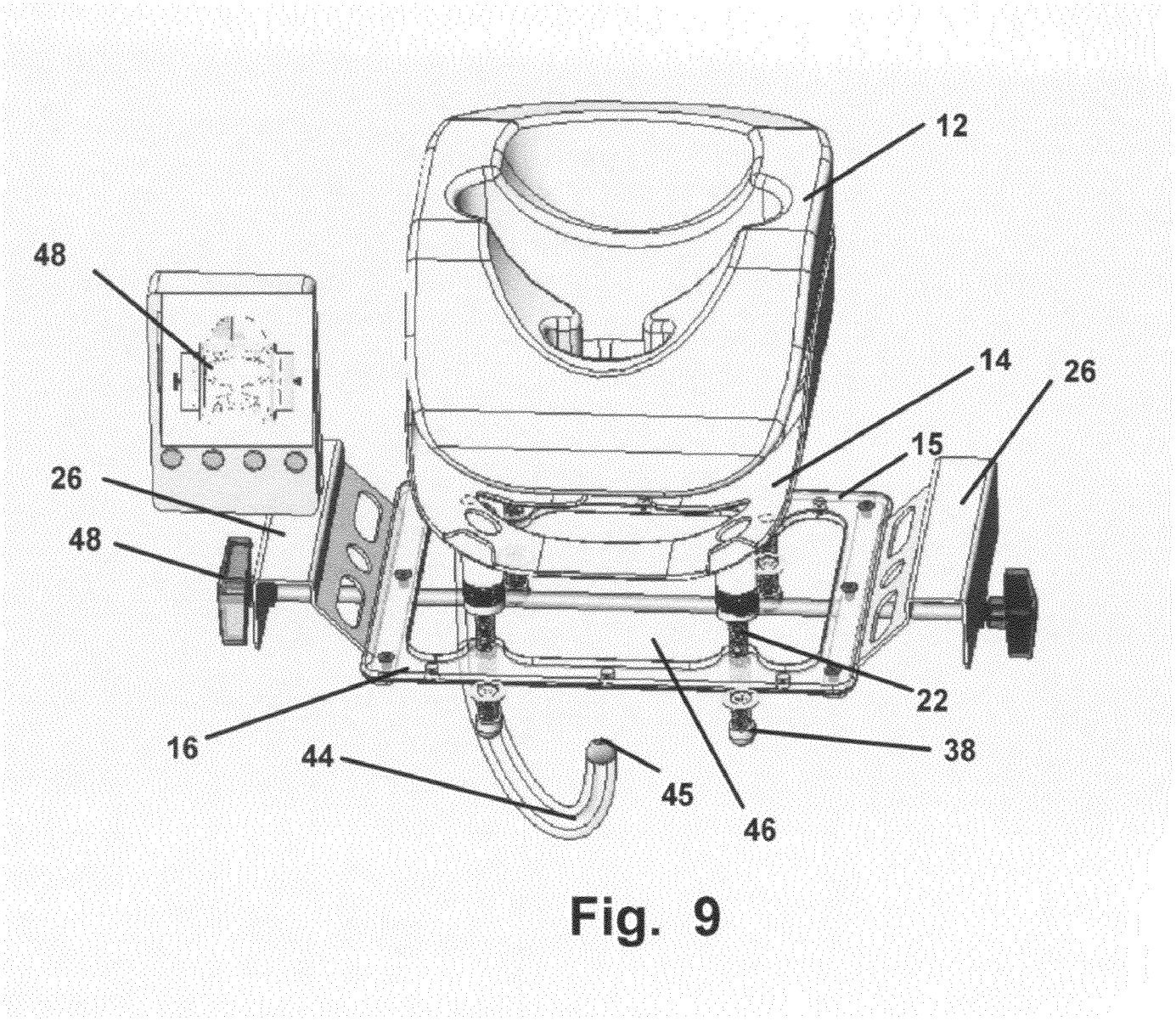
FIG. 9 depicts another mode of the embodiment of FIG. 8 showing the aperture in the tray and a video camera which may be employed alone or through an aperture in the mirror to show the patients face on and video screen.

In another preferred mode of the device 10 shown in FIGS. 8 and 9 an aperture 46 is formed into the top surface 16 of the tray 15. This aperture serves to allow a mirror 21 to be engaged to a mount 50 which allows for adjustment of the mirror's distance away from the tray 15. An aperture 52 communicates through the mirror 21 for a video camera 44 having a pinhole lens 45 to take a constant video of a patient's face and produce it on a video display 48 for upright viewing of the patient's eyes and mouth when engaged in the device 10.

In this mode of the device 10 the rails 26 will engage over extending arms of an operating table and situate the tray 15 below the top of the extending arms. A mirror adjustment 51 allows the threaded mount 50 to twist therethrough and provide means to translate the mirror 21 toward and away from the tray 15. Adjustment feet 38 are situated below the tray 15 which engages with threaded members 22 such that twisting the feet 38 turns the members 22 and will raise or lower the casing 14 from the tray 15. Thus both the mirror 21 and casing 14 may be adjusted toward and away from the tray 15 as the medical professionals decide thereby offering great customization of the viewing angles to the height of the medical personnel in the operating room, and to adjust the patient's neck for proper posture during the operation.

In both modes shown in FIGS. 7-8 handles 48 may be operated to slightly bend the sides of rails 26 to provide a means for compression upon the arms or struts 28 (FIG. 2) which extend from many operating tables. This compressed engagement provides a means for a secure non-sliding mount on the struts 28 for patient safety and comfort and to maintain the tray 15 and engaged mirror 21 aligned such that the aperture 52 will be positioned inline with the pinhole lens 45 of the video camera 44 during the operation and maintain the picture of the patient's face on the video display 48.

The video display 48 as shown in FIG. 9 may be employed with, or without the mirror 21 in place below the aperture 17 in the tray 15. This allows medical professionals to use one or both means to display a picture of the patient's face or eyes and mouth during the operation. If both are employed, or for some reason if the video display 48 fails due to power or camera problems, the mirror 21 still provides a secondary means to view the patient's face, eyes and mouth, from a position adjacent to the operating table engaging the tray 15. While all of the fundamental characteristics and features of the present invention have been described herein with reference to particular embodiments thereof, a latitude of modification, various changes and substitutions are intended in the foregoing disclosure and it will be apparent that in some instance, some features of the invention will be employed without a corresponding use of other features without departing from the scope of the invention as set forth. It should be understood that such substitutions, modifications, and variations may be made by those skilled in the art without departing from the spirit or scope of the invention. Consequently, all such modifications and variations are included within the scope of the invention.

What is claimed is:

1. A support for the head of a patient comprising:

a tray having a top surface and a bottom surface, an upper edge, and lower edge, and two opposing side edges, said tray adapted for support on an underlying surface;

a plurality of members, each of said members projecting from a distal end below said top surface, through an engagement point on said tray, to a proximal end, said proximal end positioned a distance above said top surface;

a cushion;

said cushion having a bottom wall and two sidewalls, and interior surface adapted to engage the face of a human;

said cushion having an exterior surface; and means to engage said exterior surface of said cushion with said proximal end of said members thereby positioning said cushion in an engaged position, said distance above said top surface.

2. The support for the head of a patient of claim 1 additionally comprising:

means to adjust said distance of said proximal ends of said members above said top surface to thereby adjust said distance above said top surface of said cushion.

3. The support for the head of a patient of claim 2 further comprising:

a slot communicating from said interior surface to said exterior surface of said cushion;

said slot positioned to align with a patient's eyes when said patient's face is engaged with said cushion; and said eyes being viewable through said slot when said patient's face is engaged with said cushion and said cushion is in said engaged position said distance above said tray.

4. The support for the head of a patient of claim 3 further comprising:

am aperture formed in said top surface of said tray;

a mirrored surface, said mirrored surface engaged to a mount extending from said tray;

said mirrored surface positionable at a reflecting position below said top surface of said tray; and said eyes being viewable in said mirrored surface.

5. The support for the head of a patient of claim 4 further comprising:

said mirrored surface in an adjustable engagement to said mount whereby said reflecting position of said mirrored surface is adjustable closer to and further from said tray.

6. The support for the head of a patient of claim 4 further comprising:

a viewing aperture communicating through said mirrored surface;

a video camera positionable to capture electronic images of said eyes through said viewing aperture in said mirrored surface from a position below said mirrored surface; and whereby both said mirrored surface, and a video display operatively engaged with said video camera can concurrently display images of said patient's eyes.

7. The support for the head of a patient of claim 5 further comprising:

an viewing aperture communicating through said mirrored surface;

a video camera positionable to capture electronic images of said patient's eyes through said viewing aperture in said mirrored surface from a position below said mirrored surface; and whereby both said mirrored surface, and a video display operatively engaged with said video camera can concurrently display images of a patient's eyes.

8. The support for the head of a patient of claim 1 further comprising:

a slot communicating from said interior surface to said exterior surface of said cushion;

said slot positioned to align with a patient's eyes when said patient's face is engaged with said cushion; and said eyes being viewable through said slot when said patient's face is engaged with said cushion and said cushion is in said engaged position said distance above said tray.

9. The support for the head of a patient of claim 8 further comprising:

am aperture formed in said top surface of said tray;

a mirrored surface, said mirrored surface engaged to a mount extending from said tray;

said mirrored surface positionable at a reflecting position below said top surface of said tray; and said eyes being viewable in said mirrored surface.

10. The support for the head of a patient of claim 9 further comprising:

said mirrored surface in an adjustable engagement to said mount whereby said reflecting position of said mirrored surface is adjustable closer to and further from said tray.

11. The support for the head of a patient of claim 10 further comprising:

an viewing aperture communicating through said mirrored surface;

a video camera positionable to capture electronic images of said patient's eyes through said viewing aperture in said mirrored surface, from a position below said mirrored surface; and whereby both said mirrored surface, and a video display operatively engaged with said video camera can concurrently display images of said patient's eyes.

12. The support for the head of a patient of claim 9 further comprising:

a viewing aperture communicating through said mirrored surface;

a video camera positionable to capture electronic images of said patient's eyes, through said viewing aperture in said mirrored surface from a position below said mirrored surface; and whereby both said mirrored surface, and a video display operatively engaged with said video camera can concurrently display images of a patient's eyes.

* * * * *